2/11/86 XA 4,569,755

United States Patent [19]

McGinley et al.

[11] Patent Number: 4,569,755

[45] Date of Patent: Feb. 11, 1986

[54] EXTRACTION OF AROMATICS WITH N-CYCLOHEXYL-2-PYRROLIDONE

[75] Inventors: Thomas J. McGinley, Wilmington, Del.; Peter Hosler, Wallingford, Pa.

[73] Assignee: Sun Refining and Marketing Company, Philadelphia, Pa.

[21] Appl. No.: 701,714

[22] Filed: Feb. 14, 1985

Related U.S. Application Data

[63] Continuation-in-part of Ser. No. 687,707, Dec. 31, 1984, abandoned.

[51] Int. Cl.[4] ..... C10G 21/20

[52] U.S. Cl. ..... 208/326; 208/321; 208/323

[58] Field of Search ..... 208/326, 321, 323, 324

[56] References Cited

U.S. PATENT DOCUMENTS 3,451,925 6/1969 Morris et al. ..... 208/321
3,617,535 11/1971 Weitz ..... 208/326 X
3,953,324 4/1976 Deal et al. ..... 208/321
4,328,092 5/1982 Sequeira, Jr. ..... 208/326

FOREIGN PATENT DOCUMENTS 43685 1/1982 European Pat. Off. .

*Primary Examiner*—D. E. Gantz
*Assistant Examiner*—Glenn Caldarola
*Attorney, Agent, or Firm*—J. Edward Hess; Donald R. Johnson; Stanford M. Back

[57] ABSTRACT

This invention relates to a low energy process for the solvent extraction of aromatic hydrocarbons from hydrocarbon streams containing the same, using as the solvent N-cyclohexyl-2-pyrrolidone together with small amounts of water. This solvent may be recovered from the aromatics by cooling the aromatic/solvent mixture, and adding water, whereby separation takes place without distillation. The solvent may then be separated from the water by heating the solvent/water mixture.

18 Claims, 1 Drawing Figure

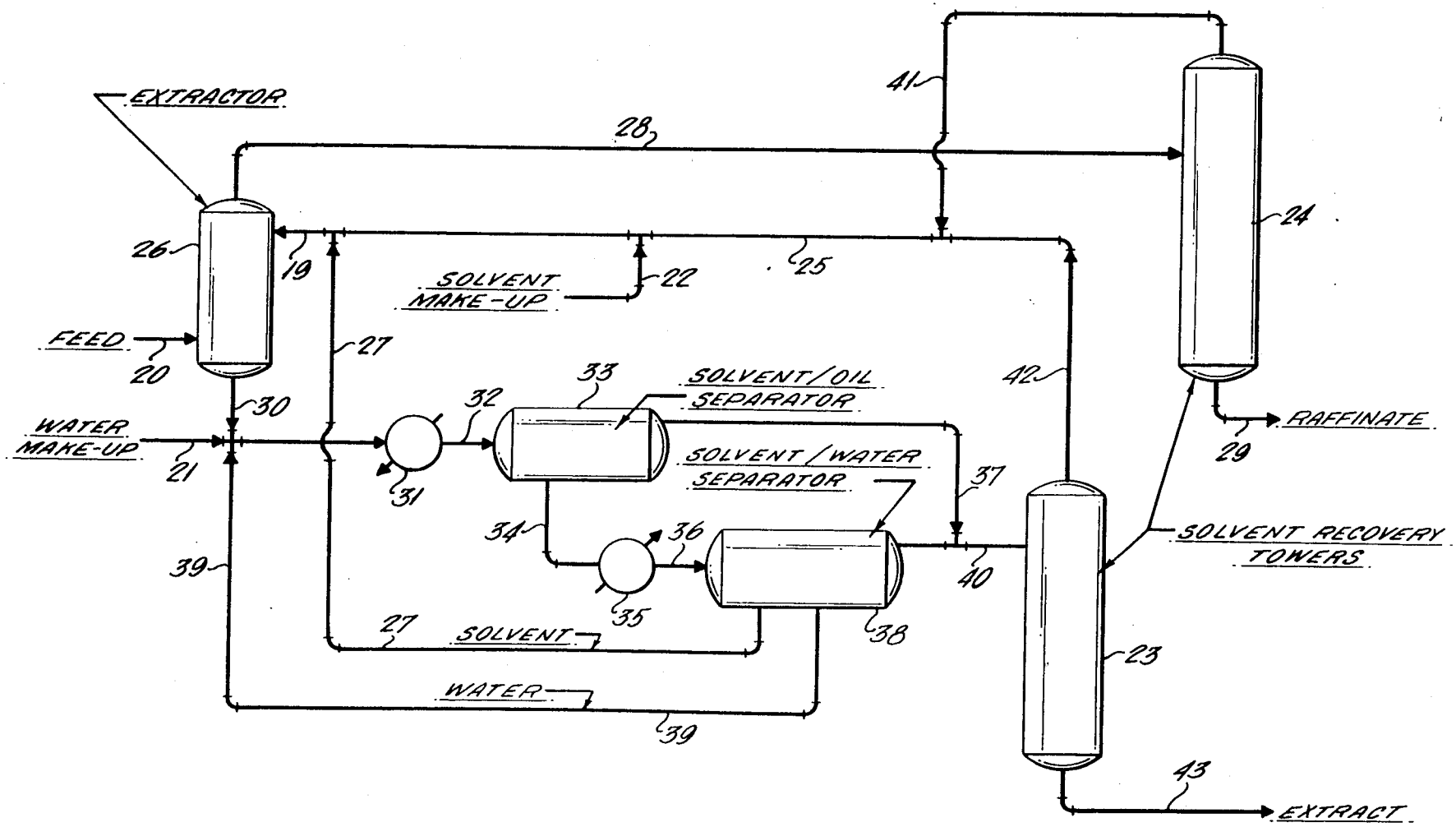
RAFFINATE
SOLVENT RECOVERY TOWERS
EXTRACT
SOLVENT/OIL SEPARATOR
SOLVENT/WATER SEPARATOR
SOLVENT MAKE-UP
SOLVENT
WATER
EXTRACTOR
FEED
WATER MAKE-UP
24
29
23
43
42
41
37
40
38
25
22
28
33
36
35
39
32
34
31
27
19
30
26
20
21

EXTRACTION OF AROMATICS WITH N-CYCLOHEXYL-2-PYRROLIDONE

CROSS REFERENCE RELATED CASES

This application is a continuation-in-part of U.S. application Ser. No. 687,707 filed Dec. 31, 1984 in the names of Thomas J. McGinley et al., and entitled "Extraction of Aromatics with N-Cyclohexyl-2-Pyrrolidone", now abandoned.

BACKGROUND OF THE INVENTION

1. Field of the Invention

This invention relates to an improved method for extracting aromatic hydrocarbons in high yields from mixed hydrocarbon feed streams containing the same. More particularly, this invention relates to a low-energy process for the solvent extraction of aromatic hydrocarbons from non-aromatic hydrocarbons, including naphthenic and paraffinic hydrocarbons, using as the solvent N-cyclohexyl-2-pyrrolidone, and thereafter separating the solvent from the aromatic hydrocarbons utilizing minimum high-energy distillation means. The process is particularly applicable to the separation of aromatics from suitable mixed hydrocarbon streams in the preparation of lubricating oils.

2. Prior Art

The separation of aromatic from non-aromatic hydrocarbons to recover both aromatic feedstock such as benzene, xylene, toluene and the like, and non-aromatic hydrocarbons useful as lube oils, is well-known in the art. In almost all instances these processes have been directed to the use of solvents which selectively extract the aromatics from the mixed hydrocarbons, the differences in the prior art methods being principally involved with the choice of solvent which will remove those aromatics to thereby impart the most desirable characteristics to the resulting lubricating oil, such as viscosity, color, stability and the like, by removal of as much of the aromatics as possible. Thus, one of the major objectives in the choice of a solvent is its ability to remove as many of the "undesirable" aromatics as possible to provide a lube oil with these highly desirable properties.

In addition to the selective extraction abilities of solvents, a major economic consideration in the choice of solvents and related methods is the ability of the solvent to be separated and recovered from the aromatic hydrocarbons in order that it could be recycled and reused in the extraction process. Thus, it has been a further major objective of the prior art methods to choose a solvent or class of solvents which could readily be recovered from the aromatic phase of the extraction process in the most economical way possible. These prior art solvent recovery methods, which have been characterized by the use of such solvent systems as phenols, furfural, N-methyl pyrrolidone, and the like combined with secondary techniques such as steam, or combination of solvents, have proved generally effective for the purposes intended. However, most if not all of them have been highly energy-intensive in that they in that they have required at least one, and often more, heating and distillation steps, the distillation being the most energy-costly of all. Thus, it is also a major objective in the choice of a solvent that it be recoverable in as energy-effective a manner as possible.

A summary of the prior art which represents both the conventional, energy-intensive methods, and more energy-conservative methods, can be found in European Patent Office publications Nos. 43,267 and 43,685 (1982), the prior art discussions of which are incorporated herein by reference.

One example of a "low-energy" process which is pertinent to the process of the present invention is disclosed in the above Euro. Pat. No. 43,267, in which, following a conventional extraction step with an aromatic-selective solvent to form a raffinate phase and an aromatic-rich solvent phase, the latter is cooled to further form an aromatic extract phase and a solvent phase, the solvent is recycled and the aromatic hydrocarbons are recovered. Further taught in this process is the possibility of using such solvents as N-methyl-2-pyrrolidone, and "anti-solvents" such as water, ethylene glycol, glycerine and the like in conjunction with the extraction procedure.

Euro. Pat. No. 43,685, also mentioned above, teaches a related "low-energy" process in which an aforementioned "anti-solvent" for the extracted aromatics, for example water, is added to the aromatic-rich solvent phase following extraction to promote separation of the aromatic and solvent phases.

Having regard for the above methods, it is thus an object of this invention to provide a low-energy process which will result in both highly effective selective extraction of aromatic hydrocarbons from mixed hydrocarbon streams containing the same to provide a lube oil of high quality, and at the same time a means for recovering the solvent without the expenditure of huge amounts of energy and/or equipment.

SUMMARY OF THE INVENTION

In accordance with the present invention, it has now been found that the foregoing objects can be achieved when there is employed as the solvent in the selective extraction of aromatics from mixed hydrocarbons containing the same, the compound N-cyclohexyl-2-pyrrolidone.

N-cyclohexyl-2-pyrrolidone (CHP) has the desirable property of low volatility. Although the pure compound is miscible with petroleum oils, it has been found that partial miscibility and selectivity for aromatics can be readily achieved by addition of an appropriate amount of water.

This solvent has a unique solubility relationship with water that is inversely related to temperature. That is, below about 50°–55° C. it is miscible with water in all proportions. Above this temperature the solubility decreases, causing a liquid phase separation. It has now been found that this quality permits a novel energy-efficient lube oil extraction process in which the spent extraction solvent can be recovered for recycling by the temperature-dependent liquid phase separation, instead of a costly distillation. The liquid phase extraction process of the present invention thus comprises the steps of:

(a) contacting a mixed hydrocarbon feed containing aromatic and non-aromatic hydrocarbons in an extraction zone with the solvent N-cyclohexyl-2-pyrrolidone and minor amounts of water sufficient to decrease the miscibility of the non-aromatic hydrocarbons in the solvent, at an elevated temperature, to provide an aromatic-rich N-cyclohexyl-2-pyrrolidone solvent phase containing primarily aromatic hydrocarbons, solvent, and water, and a raffinate phase containing primarily non-aromatic hydrocarbons;

(b) recovering the aromatic-rich solvent phase, and introducing additional water to said phase sufficient to allow phase separation of the aromatics and the solvent when the aromatic-rich solvent phase is cooled;

(c) cooling the aromatic-rich solvent phase sufficiently to form an upper phase containing primarily aromatic hydrocarbons and residual solvent, and a lower solvent phase containing primarily solvent, water, and residual hydrocarbons;

(d) recovering and heating the solvent phase in (c) until an upper phase containing primarily any residual hydrocarbons, a middle phase containing primarily said water, and a lower phase containing primarily said N-cyclohexyl-2-pyrrolidone, are formed; and (e) recovering the aromatic hydrocarbons and the raffinate.

In a preferred embodiment, as described in detail below, the solvent of step (d), together with minor amounts of water admixed therein, may then be recycled to the extraction zone, thereby effecting substantial economies. The water recovered in step (d) may likewise be recycled if desired. Moreover, in a further preferred embodiment, any residual solvent remaining in the raffinate and aromatic extract is desirably recovered by known methods and likewise recycled to the extraction zone.

In general, depending upon the uses to which the raffinate and aromatics are to be put, these two product streams may then be further treated to purify them, separate them from any entrapped solvent and the like, in accordance with processes known in the art.

DESCRIPTION OF THE PROCESS

In carrying out the process of this invention with the above-described extraction solvent N-cyclohexyl-2-pyrrolidone, many of the individual step-by-step operations and operating conditions will be understood by those skilled in the art as being within known ranges and expedients. However, the sequence of steps, the temperature ranges within which they are performed, and the ratio of components should be carefully observed when employing the pyrrolidone solvent of this invention. Moreover, the exact treatment of the resulting product streams will be dependent upon the nature of the original feedstock, the degree to which the "individual" aromatics have been removed, and the particular use to which the final product streams are to be put.

As noted above, the feedstock to which this invention is particularly applicable are those mixed hydrocarbon feeds known in the art which contain aromatic, naphthenic, and paraffinic hydrocarbons wherein the non-aromatic component comprises mineral oils useful as lubricating oils. Typical feedstocks which may thus be suitably treated are those derived by vacuum distillation of crude oils, and generally boiling in the range of from about 350° to 600° C., preferably 380° to 550° C.

In general, subject to known engineering expedients, the aforedescribed process may desirably be carried out under the following conditions, which may be read in connection with FIG. 1 and the description thereof below.

The ratio of N-cyclohexyl-2-pyrrolidone (hereinafter "solvent") to hydrocarbon feed in the extraction zone is desirably in the range of from about 1 to 4, and preferably 2 to 3, parts by weight of solvent to one part by weight of feed, depending upon the exact nature of the feedstock. It should be noted that as contrasted with many prior art extraction solvents, including those of Euro. Pat. No. 43,267, the volume of solvent employed herein and recycled is quite low, thereby effecting substantial economies in materials and equipment.

The temperature in the extraction zone should be greater than about 60° C., desirably 80°-140° C., and preferably from about 90° to 130° C., while the pressure should be adequate to maintain a liquid phase extraction, desirably about 1 to 3 atm.

Again, each of the operating conditions can be varied in accordance with the exact nature of the feed, as known in the art. The extraction equipment may be of known, conventional design, for example, of the rotary disc contactor type containing a plurality of centrally mounted discs supplemented by pumps, etc. or arrangements of equivalent design. Other equipment such as coolers, heat exchangers, etc. are also of conventional design.

Water is added to the solvent in the extraction zone to decrease the misicibility of the non-aromatics in the solvent and thus form in a two phase raffinate-extract system in the extractor. Excess water is disadvantageous as it reduces the capacity of the solvent for aromatics and if enough water is added a three phase system is eventually obtained. The water should be present in minor amounts, desirably in amounts of about 0.04 to 0.4, and most preferably about 0.1 to 0.3 parts water by weight per weight of the solvent. Generally, this water will be present in sufficient quantity admixed with the recycled solvent (described below), but additional amounts may be added, if necessary, to the solvent before introducing it into the extractor.

The raffinate is then separated from the extract or aromatic rich solvent phase. Additional water should then be added to the recovered solvent phase in an amount sufficient to cause separation of the aromatic and solvent when this phase is cooled. This additional water may, if desired, be obtained by recycle from a later separation stage, as described below. Generally, the ratio of total water to solvent in the cooling zone should be at least in the range of about 0.5:1 to 2:1 by weight, although these amounts may have to be adjusted somewhat to allow for differences in percentages of aromatics in the feedstock. If not enough water is added, the system will remain single phase; adding more water than is necessary to obtain two phases is costly because it increases the amount of water circulating in the system.

In the cooling zone, where the aromatic and the solvent/water phases are formed and separated, the temperature should be less than about 55° C., desirably 30°-55° C., and preferably about 30° to 50° C., again depending upon the exact nature of the original feedstock.

The solvent/water phase recovered from the cooling zone is then heated in a third zone to form a three phase system. The top phase is any residual aromatics which are decanted. The middle or second phase is essentially water which is withdrawn and desirably recycled, as is the solvent which forms the bottom layer of the zone. The temperature of this zone should be maintained at least about 60° up to about 140° C. and preferably about 90° to 130° C. in order to effect this phase separation. Each of the recycled materials, i.e. the water and N-cyclohexyl-2-pyrrolidone solvent, may be reutilized without further treatment or purification.

Optionally, depending upon the nature of the feedstock and rigorousness of the extraction conditions, additional intermediate operations may be performed prior to removal of any solvent from the products, to obtain higher purity materials. Thus, for example, the raffinate phase from the extractor may, if desired, be treated in a second extractor with a separate system.

After any intermediate treatment or purification, the aromatic extract ("extract oil"), which may contain various amounts of solvent, up to 200%, admixed with it, is desirably further processed by steam or nitrogen stripping, vacuum distillation, or a combination thereof, to remove solvent for recycling to the extractor. Thereafter, it may be further treated to refine and separate the same into desired fractions by known methods.

In a like manner, the raffinate recovered from the extraction steps, which may contain a few percent of solvent admixed with it, may also be further treated in a number of ways, depending upon the particular end use to which the raffinate is to be put. Thus, for example the raffinate may be processed by steam or nitrogen stripping, vacuum distillation, or a combination thereof.

It will thus be seen from the foregoing that the selective solvent of this invention has uniquely desirable properties in that it not only is a highly effective extraction solvent, but also, when cooled to temperatures below about 55° C., it separates out from the extracted aromatics in significant quantities sufficient for it to form a separate phase together with the water. Finally, and most significantly this solvent also readily separates from the water itself when heated, thereby allowing for recovery and recycling to the extractor without heavily energy-defendent distillation steps.

BRIEF DESCRIPTION OF THE DRAWING

FIG. 1 is a schematic flowsheet illustrating one embodiment of the above-described invention.

DESCRIPTION OF PREFERRED EMBODIMENTS

In FIG. 1, a heated, mixed hydrocarbon feed containing aromatics, naphthenics and paraffinics is introduced through line 20 into the bottom of countercurrent extractor 26 where it is passed countercurrent to the N-cyclohexyl-2-pyrrolidone solvent which is introduced into the top of the extractor through makeup line 22 and recycle lines 19, 25, 27, 41 and 42. The extraction zone temperature preferably should be in the range of from about 80° to 130° C., as a result of the solvent having been heated and recycled from separator 38, as described below, as well as from the heated feed stream. Minor amounts of water, resulting from the phase distribution in separator 38, are included with the solvent and recycled with it to the extractor. For start-up purposes, however, these minor amounts of water, for purposes of decreasing the miscibility of the non-aromatics in the solvent, may be introduced through line 22, together with sufficient start-up solvent, to initiate the process.

As a result of the extraction with the N-cyclohexyl-2-pyrrolidone the aromatics are substantially removed from the mixed feed, and the concentrated non-aromatic rich phase (raffinate) is removed overhead from the extractor through line 28 where it is further processed, if necessary, in recovery tower 24 and thereafter withdrawn through line 29.

The aromatic-rich phase containing the solvent and water is recovered from the bottom of the extractor through line 30 together with recycled water from line 39 and passed together with makeup water from line 21 into cooler 31 and then sent via line 32 into separator 33, where separation of the solvent and aromatic extract oil is substantially achieved. This separation is accomplished, as described above, by cooling the total mixture to a temperature of preferably about 30° to 55° C. The concentrated extract oil, which is thereafter collected through overhead lines 37 and 40 and passed into recovery tower 23, forms a top layer and is separated from the bottom layer comprising the solvent/water mixture. This latter mixture is then withdrawn through line 34 into heater 35, and then sent through line 36 to separator 38. In this separator the solvent/water mixture is preferably heated to about 80° to 130° C., resulting in the separation of the N-cyclohexyl-2-pyrrolidone, in the bottom phase, which is withdrawn and recycled via line 27 to extractor 26 together, generally, with minor amounts of water admixed therein; the water, in the middle phase, is recycled via line 39 to cooler 31. To the extent that any extract oil (aromatics) may yet be remaining in the solvent/water mixture, it too separates out during the heating, and is withdrawn through line 40 to be combined with the separated extract oil removed from separator 33 via line 37 for further treatment in tower 23.

It should be understood that this latter separation of water and solvent in separator 38, which takes place by gravity, represents a significant advantage over the conventional, energy-intensive distillation methods of the prior art. In this separation, residual extract oil, if any, forms the top layer of the three phases which result from heating the solvent/water mixture, the water forms the middle layer, while the solvent forms the bottom layer. Each of these layers may then be withdrawn separately by conventional means and treated or recycled, as the case may be.

Further treatment of raffinate and extract oils to prepare them for final use may be effected in towers 24 and 23 respectively, and thereafter withdrawn from the bottom of these towers through lines 29 and 43.

In tower 24, the raffinate from the extractor may be vacuum distilled at 140° C., 5 mm Hg absolute pressure, in order to remove any residual solvent admixed therein, generally no more than about 5 to 15 percent by weight. Alternatively, the raffinate may be contacted with steam in order to strip the solvent for recycle. After recovery from the raffinate, the solvent may be recycled to the extractor through overhead line 41. These two methods, i.e. vacuum and steam, are conventional separation/recovery expedients which may be applied routinely by those skilled in the art.

The aromatic extract oil recovered from separators 33 and 38, and which may contain up to 200 percent by weight of solvent, may then be vacuum distilled in tower 23, where the residual solvent is further separated from the aromatic extract and recycled through lines 42, 25 and 19 to the extractor. Alternatively, the further separation of the residual solvent may be achieved by steam stripping, which may be followed by vacuum distillation to remove the water.

EXAMPLES

This invention will now be illustrated by, but not limited to, the following examples, in which, in Examples 1 and 3, the process is carried out in a batch-wise fashion, and in Example 2, a continuous process. It should be noted that Example 3 is a comparative example in which it is demonstrated that the closely-related solvent N-methyl-2-pyrrolidone fails to give a phase separation after water addition and cooling of the aromatic-rich solvent phase.

In these examples there was used a crude lubricating oil feedstock having a viscosity index of about 52 (as determined by ASTM Method D2270). The viscosity index is a measure of the amount of aromatic hydrocarbon in the feedstock, along with the non-aromatic hydrocarbons. I.e., an increase in viscosity index is an indication that that amount of aromatics in the feedstock has decreased. Thus, a viscosity index of at least about 70, and preferably above about 90, is an indication that dearomatization has occurred.

EXAMPLE 1

The principle of this novel extraction process is illustrated in the following laboratory batch demonstration in which the amounts are in parts by weight based on the weight of charged material. One hundred parts by weight of feedstock, described in Table I, was combined with 250 parts N-cyclohexyl-2-pyrrolidone (CHP) and 25 parts water in a laboratory separator funnel. The mixture was heated to 93° C., shaken, and allowed to settle to form two phases. The top layer (raffinate) (65 parts) was separated and vacuum distilled to remove solvent, and yielded 51 parts of a 90 VI (viscosity index) oil. The bottom layer (300 parts) extract oil plus solvent plus water, was combined with an approximately equal weight of water (307 parts), cooled to 46° C., and settled in the first decantation. The top layer of this stage (44 parts) contained aromatic extract (40 parts). The bottom layer (561 parts) of the first decantation comprised a single phase containing CHP, water, and a small amount of extract oil. Heating this material to 93° C. resulted in the formation of three liquid phases for a second decantation step. The top phase (8 parts) yielded an additional 7 parts of extract oil. The middle phase (217 parts) contained 15 parts CHP and 202 parts water. The bottom phase (312 parts) contained 228 parts CHP and 84 parts water.

Thus it is seen from the analysis given in Table I that a feedstock of 52 VI containing 19 wt % aromatic carbons, can be selectively extracted in one stage to give 51 wt % raffinate of 90 VI, and containing 11 wt % aromatic carbons. Further, the aromatic extract can be essentially separated from the extraction solvent by decantation steps at moderate temperatures, rather than by distillation, and the solvent recovered from these decantation steps is suitable for recycle.

TABLE I

| | ASTM Method | Charge | Example 1 Raffinate | Example 2 Raffinate |
|---|---|---|---|---|
| Viscosity (cST@ 98.9° C.) | D-445 | 19.24 | 13.5 | 14.54 |
| Density (@ 60° C., kg/dm3) | D-1298 | .9128 | .8810 | .8891 |
| Refractive Index (@ 60° C.) | D-1747 | 1.5044 | 1.4868 | 1.4902 |
| Viscosity Index | D-2270 | 52 | 90 | 82 |
| Viscosity-Gravity Constant | D-2501 | .877 | .842 | .850 |
| Carbon Type Composition: | D-2140 | | | |
| Aromatic Carbons (wt %) | D-2140 | 19 | 11 | 13 |
| Naphthenic Carbons (wt %) | D-2146 | 35 | 32 | 33 |
| Paraffinic Carbons (wt %) | D-2140 | 46 | 57 | 54 |
| | | 100 | 100 | 100 |
| Distillation, °C. | D-1160 | | | |
| Initial | | 358 | | |
| 5% | | 430 | | |
| 10% | | 455 | | |
| 30% | | 484 | | |
| 50% | | 502 | | |
| 70% | | 521 | | |
| 90% | | 549 | | |
| 95% | | 558 | | |

EXAMPLE 2

The following pilot-scale extraction illustrates a continuous extraction operation as shown in FIG. 1, and contains calculations based on batch-scale data similar to that in Example 1. A single-stage extractor is used for purposes of this example, although it is understood that a multiple-stage extractor would be more selective for aromatics removal, giving a raffinate product of higher viscosity index. In this example, feedstock of the quality given in Table I is extracted under the following conditions:

| | |
|---|---|
| Extraction temperature | 93° C. |
| Extraction rates: | |
| Feedstock | 100 kg/hr |
| Water | 60 kg/hr |
| N—cyclohexyl-2-pyrrolidone | 240 kg/hr |
| First decantation temperature | 46° C. |
| Second decantation temperature | 93° C. |

When such an extraction is carried out, stream compositions for this extraction as shown in Table II, and a product of the quality given in Table I, are obtained.

TABLE II

Stream Compositions for Example 2 (Kg/Hr)

| | Feed | Solvent | Solvent | Solvent | Raffinate Concentrate | Raffinate | Solvent | Solvent | Solvent | Extract Concentrate | Recycle Water | Extract Concentrate | Extract |
|---|---|---|---|---|---|---|---|---|---|---|---|---|---|
| Stream Number (FIG. 1) | 20 | 19 | 25 | 27 | 28 | 29 | 30 | 32 | 34 | 37 | 39 | 40 | 43 |
| COMPOSITION: | | | | | | | | | | | | | |
| N—cyclohexyl-2-pyrrolidone | 0 | 240 | 61 | 179 | 12 | nil | 228 | 231 | 189 | 42 | 3 | 49 | nil |
| Hydrocarbon | 100 | 14 | nil | 14 | 72 | 72 | 42 | 43 | 17 | 26 | 1 | 28 | 28 |
| Water | 0 | 60 | nil | 60 | 6 | nil | 54 | 152 | 151 | 1 | 90 | 2 | nil |
| Yield (wt %) | | — | 100 | 51 | 72 | | | | | | | | |
| Composition: | | | | | | | | | | | | | |

From the above it will be seen that selective extraction of aromatics in good yield can be obtained at a mild extraction temperature and low solvent ratio, which conditions are a significant improvement over these used in current commercial extractions for making lubricating oils.

Further, only a small amount of extract remains soluble at the extract decantation stage. In Example 2, it will be seen that when 28 kg/hr of extract is recovered by phase separation, only 14 kg/hr remains in the system for recycle. Thus the ratio of extract recovered to extract remaining is shown to be in the order of magnitude of about 2, indicating a significant effectiveness of the ability of the instant solvent to recover aromatics from this feedstock. However, ratios of greater than about 1, and preferably 3 or more are also within the scope of this invention.

In the above example, out of a total of 240 kg/hr, about 179 kg/hr of solvent may be recovered for recycle by the energy-efficient phase separation of this invention, while only about 61 kg/hr of the total 240 kg/hr is recovered by conventional distillation.

The energy savings of this process, in calories, with no allowance made for cooling (by air), are illustrated by the following comparison with, for example, N-methyl-2-pyrrolidone (NMP):

TABLE III

| | CHP | NMP |
|---|---|---|
| Feedstock (kg/hr) | 1.0 | 1.0 |
| Ratio (Solvent/Feed) | 2.4 | 2.4 |
| Ratio (Water/Feed) | 0.6 | 0.12 |
| Solvent distilled (kg/hr) | 0.61 | 2.4 |
| Heat of vaporization (cal/gm) | 77 | 127 |
| Sub-total (kcal/kg feed) | 46.97 | 304.8 |
| Water distilled (kg/hr) | .08 | .12 |
| Heat of vaporization (cal/gm) | 540 | 540 |
| Sub-Total (kcal/kg. feed) | 43.20 | 64.8 |
| Sensible heat (stream 34): | | |
| Solvent & hydrocarbon | 38.73 | |
| Water | 70.97 | |
| Sub-total (kcal/kg feed) | 109.70 | |
| Total heat (kcal/kg feed) | 199.87 | 369.9 |

Thus it is seen that the total energy requirements of the system is about one-half the energy requirements of a conventional lubricating oil extraction process.

EXAMPLE 3

For purposes of the following example, the physical properties of N-cyclohexyl-2-pyrrolidone (CHP), obtained from GAF Corp, are compared to those of N-methyl-2-pyrrolidone (NMP) below:

| | CHP | NMP |
|---|---|---|
| Boiling Point, °C. | 284 | 182 |
| Specific Gravity, 15° C. | 1.03 | 0.99 |
| Water miscibility at 40° C. (v %) | miscible | miscible |
| Water miscibility at 90° C. (v %) | 30 | miscible |
| Latent heat of vaporization (cal/gm) | 77 | 127 |

The procedure of Example 1 was followed, except N-methyl-2-pyrrolidone was used instead of N-cyclohexyl-2-pyrrolidone. One hundred parts of feedstock was combined with 250 parts of solvent and 25 parts of water in a laboratory separatory funnel. The mixture was heated to 93° C., shaken, and allowed to settle.

The extract layer was separated and mixed with an equal weight of water and held at 43° C. for 18 hours, but no settling or phase separation occurred. It will thus be seen that N-methyl-2-pyrrolidone is totally ineffective for purposes of the present invention.

What we claim is:

1. A liquid phase extraction process for the dearomatization of a mixed hydrocarbon feed containing aromatic and non-aromatic hydrocarbons comprising:

(a) contacting the mixed feed in an extraction zone with the solvent N-cyclohexyl-2-pyrrolidone and minor amounts of water sufficient to decrease the miscibility of the non-aromatic hydrocarbons in the solvent, at an elevated temperature, to provide an aromatic rich N-cyclohexyl-2-pyrrolidone solvent phase containing primarily aromatic hydrocarbons, solvent and water, and a raffinate containing primarily non-aromatic hydrocarbons;

(b) recovering the aromatic-rich solvent phase, and introducing additional water to said phase sufficient to allow phase separation of the aromatics and the solvent when the aromatic-rich phase is cooled;

(c) cooling the aromatic-rich solvent phase sufficiently to form an upper phase containing primarily aromatic hydrocarbons, and residual solvent, and a lower solvent phase containing primarily solvent, water, and residual hydrocarbons;

(d) recovering and heating the solvent phase in (c) until an upper phase containing primarily any residual aromatics hydrocarbons, a middle phase containing primarily said water, and a lower phase containing primarily solvent are formed; and (e) recovering the aromatic hydrocarbons and the raffinate.

2. The process of claim 1 wherein the solvent, together with minor amounts of water, is recycled to the extraction zone.

3. The process of claim 1 wherein any residual solvent is separated from the raffinate and aromatic extract and recycled to the extraction zone.

4. The process of claim 1 wherein the water from step (d) is recycled to step (b).

5. The process of claim 1 wherein the temperature in step (a) is from about 60° to 140° C.

6. The process of claim 1 wherein the temperature in step (c) is from about 30° to about 55° C.

7. The process of claim 1 wherein the temperature in step (d) is from about 60° to 140° C.

8. The process of claim 1 wherein the ratio of solvent to feed in the extraction zone of step (a) is in the range of from about 1 to about 4 parts by weight of solvent to one part by weight of feed.

9. The process of claim 1 wherein the ratio of water to solvent in step (a) is from about 0.05 to about 0.4 parts by weight of water per weight of solvent.

10. The process of claim 1 wherein the ratio of water to solvent in step (c) is at least about 0.5 parts by weight of water per weight of solvent.

11. A liquid phase extraction process for the dearomatization of a mixed hydrocarbon feed containing aromatic and non-aromatic hydrocarbons comprising:

(a) contacting the mixed feed in an extraction zone with the solvent N-cyclohexyl-2-pyrrolidone and minor amounts of water sufficient to decrease the miscibility of the non-aromatic hydrocarbons in the solvent, at an elevated temperature, to provide an aromatic rich N-cyclohexyl-2-pyrrolidone solvent phase containing primarily aromatic hydrocarbons, solvent and water, and a raffinate containing primarily non-aromatic hydrocarbons;

(b) recovering the aromatic-rich solvent phase, and introducing additional water to said phase sufficient to allow phase separation of the aromatics and the solvent when the aromatic-rich phase is cooled;

(c) cooling the aromatic-rich solvent phase sufficiently to form an upper phase containing primarily aromatic hydrocarbons, and residual solvent, and a lower solvent phase containing primarily solvent, water, and residual hydrocarbons;

(d) recovering and heating the solvent phase in (c) until an upper phase containing primarily any residual aromatics hydrocarbons, a middle phase containing primarily said water, and a lower phase containing primarily solvent are formed;

(e) recycling the solvent with minor amounts of water to the extraction zone;

(f) separating residual solvent from the raffinate and aromatic extract, and recycling this solvent to the extraction zone; and (g) recovering the aromatic hydrocarbons and the raffinate of steps (a), (c), (d) and (f).

12. The process of claim 11 wherein the water from step (d) is recycled to step (b).

13. The process of claim 11 wherein the temperature in step (a) is from about 60° to 140° C.

14. The process of claim 11 wherein the temperature in step (c) is from about 30° to about 55° C.

15. The process of claim 11 wherein the temperature in step (d) is from about 60° to 140° C.

16. The process of claim 11 wherein the ratio of solvent to feed in the extraction zone of step (a) is in the range of from about 1 to about 4 parts by weight of solvent to one part by weight of feed.

17. The process of claim 11 wherein the ratio of water to solvent in step (a) is from about 0.05 to about 0.4 parts by weight of water per weight of solvent.

18. The process of claim 11 wherein the ratio of water to solvent in step (c) is at least about 0.5 parts by weight of water per weight of solvent.

* * * * *